US005274982A

United States Patent [19]

Price

[11] Patent Number: 5,274,982

[45] Date of Patent: Jan. 4, 1994

[54] WALL COVERING CONSTRUCTION METHOD

[76] Inventor: James M. Price, P.O. Box 4052, Lake Wales, Fla. 33859-4052

[21] Appl. No.: 896,431

[22] Filed: Jun. 10, 1992

[51] Int. Cl.[5] ..... E04G 21/22

[52] U.S. Cl. ..... 52/747; 52/284; 264/261

[58] Field of Search ..... 52/747, 275, 284, 384–; 264/261; 249/15, 16

[56] References Cited

U.S. PATENT DOCUMENTS

| | | | |
|---|---|---|---|
| 666,963 | 1/1901 | Jacquart et al. | 52/284 |
| 898,001 | 9/1908 | Pellarin | 264/261 |
| 1,909,625 | 5/1933 | Meier | 52/513 |
| 2,130,911 | 9/1938 | Teunon | 52/386 |
| 2,178,535 | 10/1939 | Willson | 249/15 |
| 2,252,539 | 8/1941 | Adams | 52/275 |
| 3,025,641 | 3/1962 | Ahtiainen | 52/415 |
| 4,177,789 | 12/1979 | Marocco | 125/12 |
| 4,185,431 | 1/1980 | Brownlee | 52/309.17 |

FOREIGN PATENT DOCUMENTS

| | | | |
|---|---|---|---|
| 703793 | 2/1965 | Canada | 52/384 |
| 2248261 | 1/1992 | United Kingdom | 52/127.2 |

*Primary Examiner*—James L. Ridgill, Jr.
*Attorney, Agent, or Firm*—William M. Hobby, III

[57] ABSTRACT

A method of constructing a simulated marble, granite or other stone wall utilizes thin slabs of stone. An existing wall is smoothed and a plurality of wood supports or spacers are attached thereto in a random pattern. The wall is coated with a suitable adhesive adjacent the wood supports or spacers. Slabs of stone are pressed into the adhesive with the lower edges resting on the wood supports or spacers. After setting of the adhesive, the wood supports or spacers are removed and the space between the blocks are filled with stone chips cemented thereto. The materials for practicing the method are generally available as scrap from stone cutters and monument makers.

10 Claims, 2 Drawing Sheets

WALL COVERING CONSTRUCTION METHOD

BACKGROUND OF THE INVENTION

1. Field of the Invention

The present invention relates to a wall covering method of using granite, marble or similar type stone material to produce a wall, and more particularly to a method of producing at a low cost a wall having the appearance of a granite, marble or similar type stone material and constructed from full size blocks and chips.

2. Description of the Prior Art

In certain types of buildings, it is desirable to have a very substantial appearance to the exterior walls such as may be obtained by forming the wall from granite or marble blocks or other available stone. However, such construction is prohibitively expensive for many builders. I have learned that a large amount of marble and granite is discarded or disposed of at scrap prices from which such walls may be covered using the present invention.

For example, in the manufacture of cemetery headstones as well as monuments, decorative statues and the like, blocks of granite and marble are routinely cut to a desired size. The excess stone material which is cut away may occur in the form of relatively thin rectangular slabs. Many of these slabs are of substantial size, but due to a lack of thickness and their random size, they are of little commercial value.

Similarly, in forming headstones and other objects from these materials, a stone mason will cut away chips of the stone material of varying sizes and shapes.

Many stone yards collect large amounts of this waste material and often must pay to have the material hauled away and dumped. Thus, such material is available for the asking or at a small cost to anyone willing to accept the material.

SUMMARY OF THE INVENTION

The present invention relates to a novel method of constructing an attractive wall surface using thin slabs and scrap chips of marble, granite or similar type stone materials. The method may be applied used on any type of existing wall structure, such as a concrete, concrete block, frame, stucco, ceramic tile backer board, water resistant sheet rock, and the like.

Assuming for purposes of explanation that a block wall is to be covered in accordance with my method, the wall surface is smoothed and any voids, cracks or chips filled. Next, a plurality of wood supports or spacers are nailed to the masonry wall at various locations in a random pattern to serve as supports for rectangular stone elements. Random size thin stone slabs are selected and any suitable adhesive, such as cement, thin set mortar or latex adhesive mortar, is applied to a rear surface of each slab and to the wall area just above each support. Each slab is then pressed into the adhesive with the wood supports or spaces providing the necessary support while the adhesive sets. Any desired pattern of slabs of stone may be set, although a random appearance is desired since it is then not necessary to match the size of slabs from one to the other. It is also desirable to leave relatively large spaces between slabs and this area will be later covered. After the stone slabs are in place, the spaces are filled with chips, and the adhesive is left to cure for about twelve hours.

After the adhesive has cured, the finished wall is then cleaned, preferably by sandblasting, or with muriatic acid or cleansers to remove any foreign materials and to present a bright, clean appearance.

It is therefore an aim of my invention to utilize irregular sized, thin granite, marble or other types of stone materials or slabs that are nonusable in conventional wall covering by spacing them farther apart and filling in the spaces with compatible chips to take up the irregularity to produce an attractive wall surface.

BRIEF DESCRIPTION OF THE DRAWINGS

These and other objects and advantages of my invention will become apparent from the written description and the drawings in which:

FIG. 1-B is an elevation of a typical wood stud wall, partially cut away to show the preparation before my method of invention can be applied;

FIG. 1-C is an elevation of a wall section of a partially finished wall using the present method;

FIG. 1-D is an elevation of a finished wall section finished with my method;

FIG. 2-B is a cross-section of FIG. 1-B during use of my method;

FIG. 2-C is a cross-section of FIG. 1-C;

FIG. 2-D is a front elevation of a section of a completed wall showing a corner treatment using the present method;

DETAILED DESCRIPTION OF THE PREFERRED EMBODIMENT

Figure 1A:
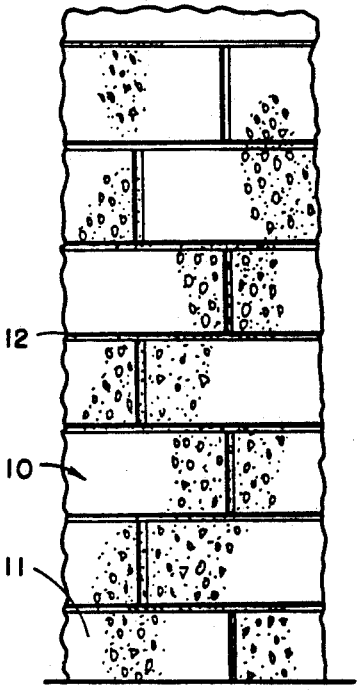
FIG. 1-A is an elevation of a typical concrete block wall.

Referring to the drawings and especially FIGS. 1 and 2, a view of a wall covering is illustrated treated in accordance with my method. A concrete block wall 10 is shown in FIG. 1A having blocks 11 held together with mortar 12. FIG. 1B shows a frame wall 13 having portions of the covering removed to expose the studs 14. In a concrete or concrete block wall 10, the materials in accordance with my method may be applied directly thereto. In frame construction or stucco wall 13, it is necessary to first apply metal lathe 15 to the existing wall. The wall in accordance with my method is then applied over the lathe 15. The wall covering may be applied to any other surfaces desired, such as ceramic, tile backer board, and water resistant sheet rock.

In FIG. 1A a concrete block wall 10 is shown and is smoothed with any voids, cracks, or the like are filled in.

Figure 1B:
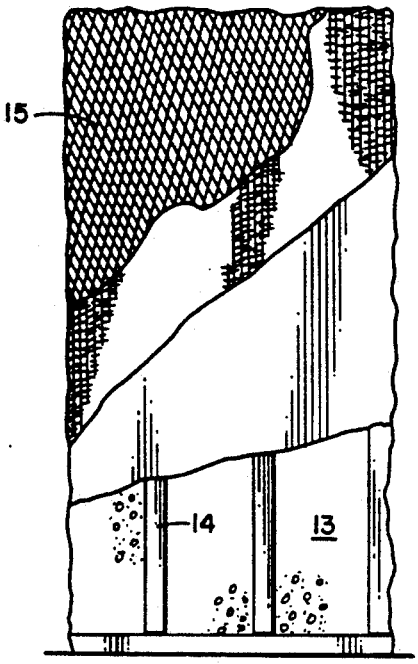
Figure 1C:
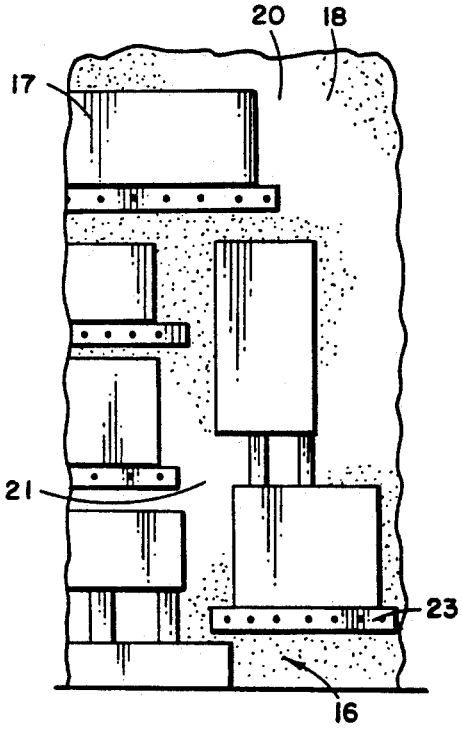

Referring to FIG. 1C, stone or marble slabs 17 are attached to the wall 16. The area 18 between slabs 17 has been coated with a suitable adhesive 20. Adhesive 20 may be thin set mortar, latex adhesive mortar or the like. Each slab 17 is a thin piece of granite, marble or similar type stone. Rectangular slabs of granite have been shown but it will be apparent that any pleasing shape may be utilized. The slabs 17 are held in place on the wall 16 with the adhesive materials 20. The spaces between slabs 17 are filled with chips 22 (FIG. 1D) of the same type of stone. The stone chips 22 are attached to the concrete block wall in FIGS. 1D by adhesive 20. The appearance of the wall can be varied by using different size chips 22 and, to some degree, by the shapes thereof. The wood blocks 23 are attached to the wall under each slab 17 to support the slab until the adhesive cures. The finished wall 24 has granite slabs 17 and granite chips 22 forming the facade in FIG. 1D.

Figure 2A:
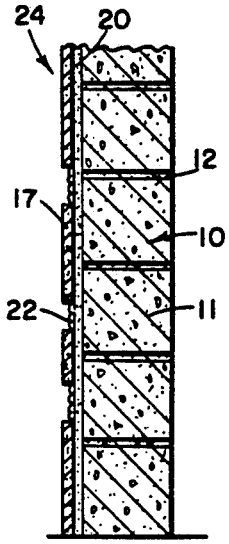
FIG. 2-A is a cross-section of FIG. 1-A showing the method of invention applied.
Figure 1D:
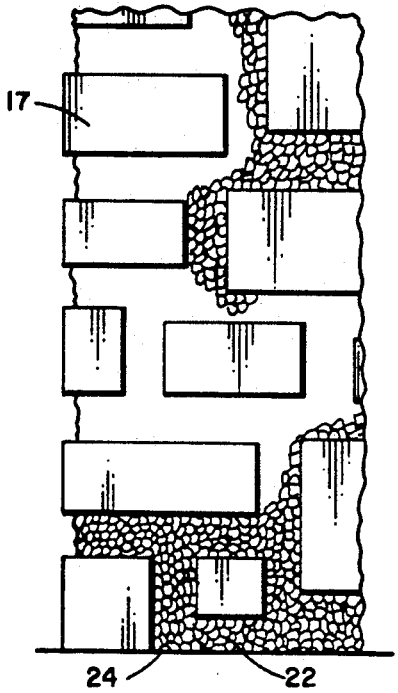

In FIG. 2A, a cross-section of the wall 14 of FIG. 1D has concrete block wall 10, has the adhesive material 20 with the slab 17, and chips 22 attached between slabs to form an interesting wall 24.

Figure 2B:
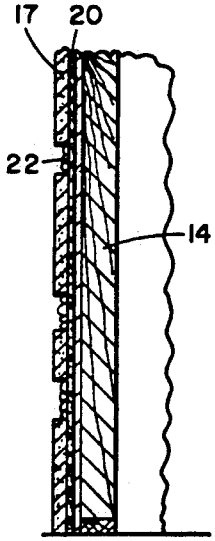
Figure 2C:
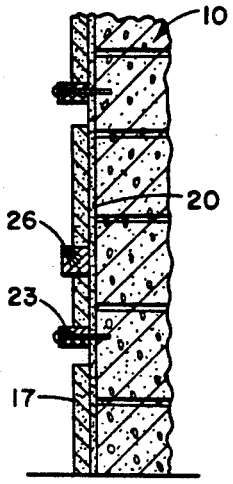
Figure 3:
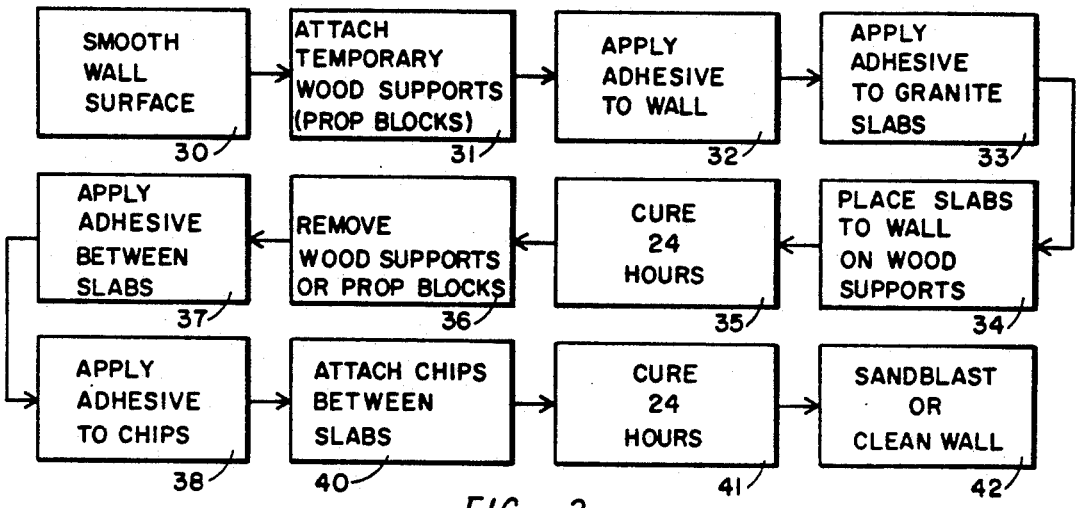
FIG. 3 is a flow diagram of the method of the present invention.

FIG. 2B has the slab 17 and chips 22 attached over the wall 13 of FIG. 1B with the expanded metal lathe 15 and adhesive 20 supported in the studs 14. FIG. 2C shows a cross-section of FIGS. 1C with the partially complete wall having the wood supports 23 thereon. Turning to FIG. 3, a flow diagram shows the typical steps of my method. The first step is to prepare or smooth the wall surface 30. An irregular wall surface, such as stucco or a wood sheathed wall surface, should have metal lathe 15 applied thereto. After preparation of the wall surface, a plurality of wood supports 23 or spacers 26 are attached 31 to the wall. The supports 23 or spacers 26 are applied at the points at which slab 17 is to be attached.

After the wood supports 23 and spacers 26 are in place, the adhesive 20 is applied to the wall in the area in which the slabs 17 are to be installed. Next, the adhesive is applied 33 to the back surface of a slab 17 which is then placed 34 against the block wall with its lower edge resting on the appropriate wood supports 23 or spacers 26. The slab 17 is supported while curing 35 by the wood supports or spacers to prevent the slap from slipping downward. After the slabs 17 are in place, the adhesive is allowed to cure 35 for 12 hours.

Figure 2D:
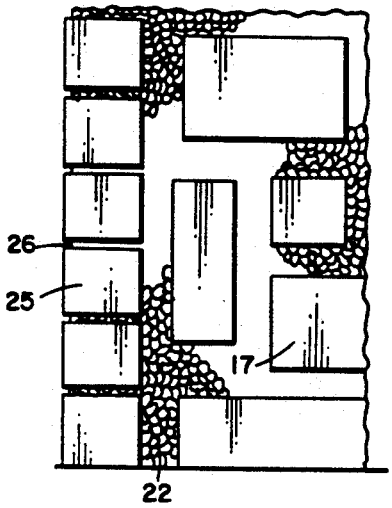

FIG. 2B has the slab 17 and chips 22 attached over the wall 13 of FIGS. 1B with the expanded metal lathe 15 and adhesive 20 supported on the studs 14. FIG. 2C shows a cross-section of FIG. 1C with the partially complete wall having the wood supports 23 thereon. FIGS. 2D is a finished corner section having the slab 17 and chips 22 mounted to the wall as in FIGS. 1D but also having quoins 25 inserted to the corner and having mortar 26 filling the spaces between the quoin slabs.

After curing, the wood supports 23 or spacers 26 are removed 36 from the wall surface and the adhesive is applied 37 to the open spaces between the slabs 17. The adhesive is applied 38 to the back surface of the chips 22 which are attached 40 in the spaces 21 between the slabs 17. When filling the space between slabs, the chips are also trimmed to fit around the corners of the slab 17 by cutting a 90 degree angle into the chips where required. The density of chips, the amount of overlap and the pattern can be controlled as desired. After application of the chips 40, the adhesive is allowed to cure 41 for twelve hours. Thereafter, the wall can be cleaned 42, preferably by sandblasting, or with muriatic acid or a cleanser as desired.

Figure 4C:
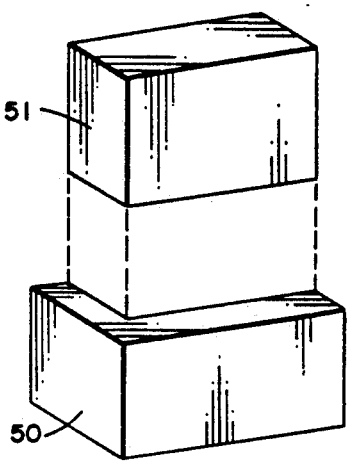
FIGS. 4-A,B,C are perspective views of a corner treatment in accordance with the present method.
Figure 4A:
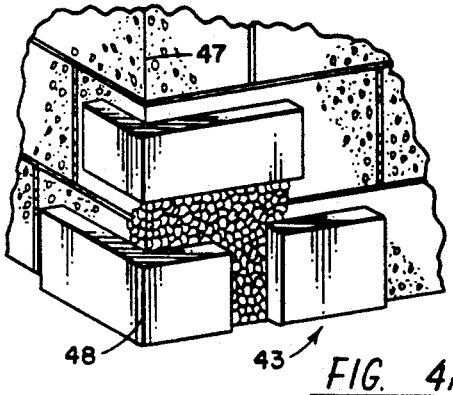
Figure 4B:
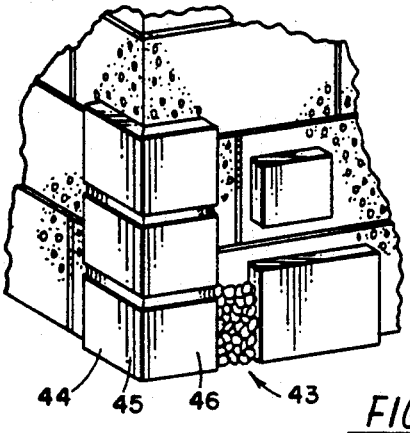

Turning to FIGS. 4A and 4B, an optional corner treatment 43 is shown. A slab is selected which is long enough to be cut into two pieces 45 and 46. The resulting pieces 45 and 46 are then installed at the corner 47 so that the heights will match exactly. The joints 48 between pieces 45 and 46 may be filled with a clear adhesive and granite granules or just colored adhesive such that the finished appearance is that of a solid block, which contributes to the illusion that the wall is formed from blocks of granite rather than thin slabs. The sharp corner of slab 45 and 46 may be sandblasted to present a rounded appearance if desired. An optional corner, as shown in detail in FIG. 4C, is formed by cutting out of a solid slab of granite 51 further adding to the illusion of a solid granite wall.

As will now be apparent, I have disclosed a method of covering a wall having the appearance of a full thickness of granite, marble or similar type stone wall, yet which can be constructed at a relatively low cost and for which the materials are generally available at scrap prices. Although I have described my process with particularity, it will be obvious that various changes can be made thereto without departing from the spirit and scope of my invention.

I claim:

1. A method for making a simulated stone wall over a wall comprising the steps of:
   - selecting slabs of stone of irregular size;
   - attaching wood on supports to a wall in an irregular pattern positioned in accordance with the selected slabs of stone;
   - applying an adhesive to the surface of the wall adjacent the wood supports;
   - attaching a slab of stone of top of each of the wood supports in contact with the adhesive;
   - curing the adhesive;
   - removing the wood supports after curing the adhesive;
   - applying an adhesive to the surface of the wall between the slabs of stone;
   - attaching stone chips in contact with the adhesive to thereby cover the wall between the attached slabs of stone.

2. The method in accordance with claim 1 includes the step of applying an adhesive to the rear surface of each slab of stone prior to attaching said slab on top of a wood support.

3. The method as recited in claim 1 in which the step of attaching a slab of stone includes attaching a slab of granite.

4. The method in accordance with claim 1 in which the step of attaching a slab of stone includes attaching a step of marble.

5. The method in accordance with claim 1 including the step of cutting a 90 degree angled outside corner block from a full block of granite.

6. The method in accordance with claim 1 includes the step of:
   - curing the adhesive on the wall for a predetermined period of time; and
   - cleaning the wall.

7. The method in accordance with claim 6 in which the step of cleaning includes sandblasting the wall.

8. The method in accordance with claim 1 in which the step of cutting a block of stone to fit a corner of an existing wall by cutting a rectangular slab of stone to obtain two rectangular slabs of stone of equal heights and adhering each of said two slabs to the corner of an existing wall with abutting edges to form a portion of a quoin on said wall corner.

9. The method in accordance with claim 8 including the step of mitering blocks of stone and attaching to the corner of a wall to form a quoin on said wall corner.

10. The method in accordance with claim 8 including the step of filling the joint between the abutting edges of the two slabs of stone with clear adhesive granulated stone material.

* * * * *